United States Patent [19]

Kutz

[11] 4,185,344

[45] Jan. 29, 1980

[54] INSTALLATION FOR DYEING TEXTILE MATERIAL IN WEB FORM

[75] Inventor: Johannes Kutz, St. Tönis near Krefeld, Fed. Rep. of Germany

[73] Assignee: Eduard Küsters, Krefeld, Fed. Rep. of Germany

[21] Appl. No.: 931,888

[22] Filed: Aug. 8, 1978

[30] Foreign Application Priority Data

Aug. 16, 1977 [DE] Fed. Rep. of Germany ..... 2736835

[51] Int. Cl.[2] ..... D06B 21/00

[52] U.S. Cl. ..... 8/149.1; 68/5 D; 68/9

[58] Field of Search ..... 8/149.1, 151, 151.2; 68/3 R, 5 D, 5 E, 9, 27, DIG. 5; 118/67, 73; 134/9, 15, 64 R, 64 P

[56] References Cited

U.S. PATENT DOCUMENTS

| | | | |
|---|---|---|---|
| 3,066,517 | 12/1962 | Deyber | 68/5 D |
| 3,803,880 | 4/1974 | Laing et al. | 68/5 D |
| 3,981,162 | 9/1976 | Klier | 68/9 X |

FOREIGN PATENT DOCUMENTS

| | | | |
|---|---|---|---|
| 1200086 | 7/1970 | United Kingdom | 68/DIG. 5 |

*Primary Examiner*—Philip R. Coe
*Attorney, Agent, or Firm*—Kenyon & Kenyon

[57] ABSTRACT

In an installation for dyeing textile material in web form comprising a preliminary washing device, a dyeing liquor application mechanism, a steamer and a final washing device, the preliminary washing device and the final washing device are disposed immediately adjacent to each other to permit feeding and removal of the web from the same side of the installation.

6 Claims, 1 Drawing Figure

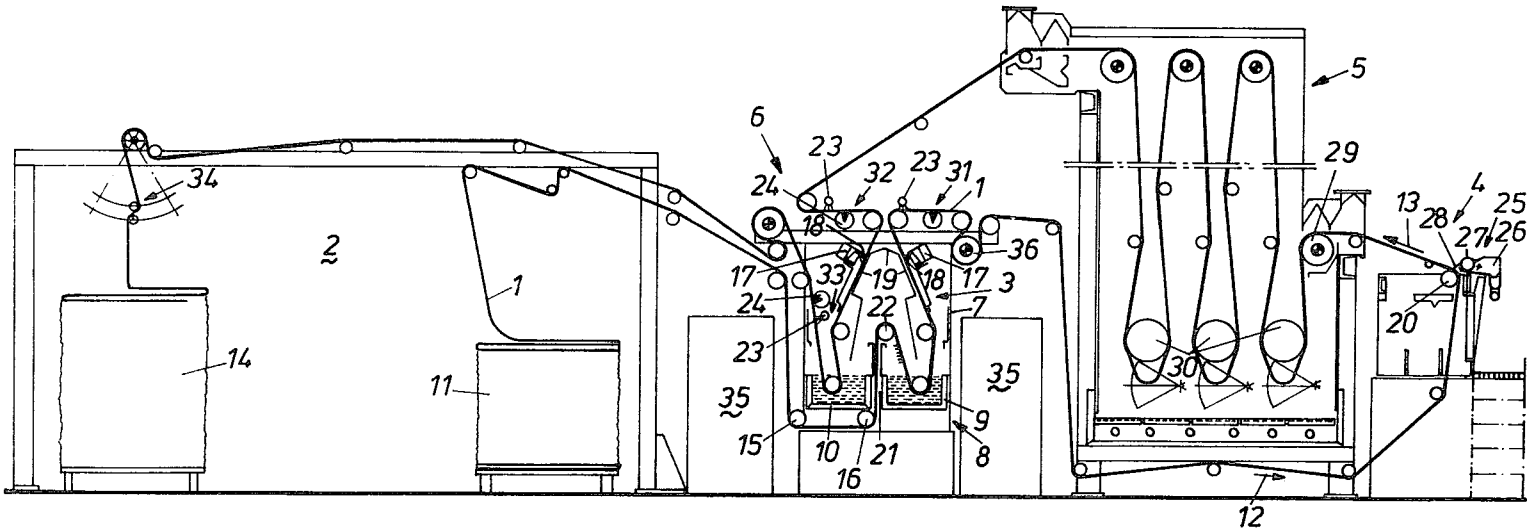
5
29
4
25
26
27
28
13
20
12
30
36
3
17
7
35
9
8
31
1
23
18
32
19
22
21
16
10
33
6
24
15
2
11
14
34

INSTALLATION FOR DYEING TEXTILE MATERIAL IN WEB FORM

BACKGROUND OF THE INVENTION

This invention relates to an installation for dyeing textile material in web form, including a preliminary washing device, a dyeing liquor application mechanism, a steamer and a final washing device, in general, and more particularly to such an installation with reduced space requirements.

In conventional installations of this kind, the components are mounted in a row, so that the preliminary washing device and the final washing device are separated on opposite sides of the steamer. The material must also, of course, be fed in at one end of the installation and drawn off again at the other end.

Separating the two washing devices increases the cost for their water and heat supply, while the separation of the input and the output increases the space required, as two approach paths are then necessary.

SUMMARY OF THE INVENTION

It is an object of the present invention to reduce the space required and the cost of the machinery in an installation of the type mentioned at the outset.

According to the present invention, this problem is solved by disposing the preliminary washing device and the final washing device directly adjacent to each other.

This allows operating the two washing devices with a single water supply arrangement. Therefore, water pipes and pumps no longer need be provided both before and after the steamer; it is sufficient to provide such installations only at one point. This also results in space savings, since the immediately adjacent and jointly supplied washing devices occupy less space than separate and separately supplied washing devices.

The preliminary washing device and the final washing device are advantageously arranged in a common housing, which reduces the structural requirements still further.

The present invention can be implemented in such a way that the path of the web has a reversal point in the horizontal direction, so that the textile material, in web form, starting from the preliminary washing device, returns to the same location to be guided into the adjacent final washing device.

In particular, the path of the web can comprise a section of forward travel extending up to the reversal point, and a section of return travel arranged above or below the former.

In detail, the section of forward travel can extend from the preliminary washing device arranged on the one side of the steamer, under the steamer, up to a dyeing liquor application mechanism arranged on the other side of the steamer, and the return section from there, above the section of forward travel, back into the steamer and from the latter into the final washing device.

The dyeing liquor application mechanism is thus provided on one side of the steamer, and the preliminary washing device and the final washing device are provided side by side on the other side of the steamer.

So that the part of the textile material in web form travelling forward does not interfere with the part of the textile material in web form returning, the final washing device is advantageously arranged ahead of the preliminary washing device, as seen in the travel direction of the forward-travel section, with the section of forward travel under the final washing device and into the preliminary washing device between the final washing device and the preliminary washing device.

In this manner, the accessibility of the final washing device for the textile material in web form returning is preserved, i.e., it is above the section of forward travel.

In a further advantageous embodiment, feeding and removal devices are arranged adjacent to each other on one side of the steamer, and the preliminary washing device and the final washing device are arranged between these devices and the steamer.

The feeding and removal devices are combined at one end of the installation, so that only one person is required for observing the feeding and removal process, and the delivery and removal can be accomplished over one and the same access path.

BRIEF DESCRIPTION OF THE DRAWING

The single FIGURE is a diagrammatic presentation of a rug dyeing installation according to the present invention.

DETAILED DESCRIPTION OF THE INVENTION

In the illustrated installation, textile material in the form of a rug web 1 is dyed. The installation comprises a feeding and removal zone 2, a preliminary washing device 3, a dyeing liquor application mechanism 4, a steamer 5 and a final washing device 6.

The preliminary washing device 3 and the final washing device 6 are located immediately side by side in a common housing 7 and form a dual washing device 8. They are arranged between the feeding and removal zone 2 and the steamer 5. The dyeing liquor application mechanism 4 is located on the other side of the steamer 5.

The rug web is delivered in a stack 11 in the feeding and removal zone 2 and is drawn off via rollers and brought to the dual washing device 8. The rug web 1 then passes under the steamer 5 into the dyeing liquor application mechanism 4, where it runs over a deflection roller 20. The section of forward travel, designated by the arrow 12, extends from the stack 11 to the reversing roller 20. The return section, marked by the arrow 13, begins at the reversing roller 20 and extends through the steamer 5 as well as through the dual washing device 8 to the stack 14 in the feeding and removal zone 2 from which the material is then removed.

The preliminary washing device 3 is arranged after the final washing device 6, as seen in the travel direction of the section 12 of forward travel, i.e., from left to right in the drawing.

Both individual washing devices 3 and 6 are substantially of the same design. The preliminary washing device 3 includes a washing liquid trough 9 in its lower portion, and the final washing device 6, a washing liquid trough 10 in its lower portion. Above the washing liquid troughs 9 and 10, slit nozzles 17, which extend across the width of the web and direct large quantities of water in a knife-like jet against the passing rug web 1, are arranged. These nozzles 17 are further aided in the impingement zone by a baffle arrangement 19. The rebounding washing liquid is conducted by baffles into the washing liquid troughs 9 and 10 located underneath.

The rug web 1 is brought to the dual washing device 8 over guide rollers 15 and 16 arranged under the washing liquid trough 10 of the final washing device 6, and then reaches the top through a space 21 between the washing liquid troughs 9 and 10. In order to then get from above into the washing liquid trough 9 it is conducted over a deflection roller 22 and then conducted upward again past the slit nozzle 17. After passing the slit nozzle 17, the rug web 1 runs past a further washing arrangement 31 which comprises a spraying nozzle 23 and a suction device 24 immediately following the nozzle 23. The rug web then runs around a traction cylinder 36 which can be driven in a controlled manner, and is subsequently conducted under the steamer 5 and through the dyeing liquor application mechanism 4, which is arranged on the other side of the steamer. This mechanism comprises a doctor blade applicator 25 with a cylinder 27 which rotates in the direction of the arrow in a dyeing liquor trough 26. The cylinder 27 carries the dyeing liquor along on its surface and the dyeing liquor is wiped from the surface by means of a wiper 28, over which the dyeing liquor runs down on the rug web 1 at an angle. The rug web then arrives, with the freshly applied dyeing liquor, at the steamer 5 via a further traction cylinder 29. The steamer 5 is designed as a conventional suspended loop steamer with additional guide rollers 30 arranged in the lower portion of the suspended loops.

The rug web 1, which, after passing over the deflection roller 20, extends above the section 12 of forward travel, after leaving the steamer 5, is conducted into the final washing device 6 from above. It first passes, again, through a washing device 32 of spraying nozzles 23 followed by a suction device 24, then passes a slit nozzle 17 as well as passing through the washing liquid trough 10 and is then conducted under another washing arrangement 33 consisting of a spraying nozzle 23 and suction device 24 upward out of the dual washing device 8 and returns, above the section 12 of forward travel, to the feeding and removal zone 2, where it is stacked into a stack 14 by means of a stacking device 34.

An essential feature of the present invention is the combination of the preliminary washing device 3 and the final washing device 6 in a dual washing device 8. The latter permits accommodating the two individual washing devices in a common housing 7 and supplying the nozzles 17 and 23 with a common set of pumps 35. The supply lines for water therefore need only be installed at one point and not at two points separated a large distance from each other on opposite sides of the steamer. Combining the preliminary washing device 3 and the final washing device 6 in a dual washing device 8 also permits having the input and the output of the rug web 1 at one and the same end of the installation, so that the goods can be both fed in and transported away at a common feeding and removal zone 2. One operator can observe the proper running of the material in the stack 11 as well as in the stack 14, and only one access path to this common feeding and removal zone need to be provided.

What is claimed is:

1. An installation for dyeing textile material in web form comprising: a steamer; a dyeing liquor application mechanism disposed on one side of said steamer; a dual washing device having a common housing and having disposed therein a preliminary washing device and a final washing device disposed on the other side of said steamer; and means for guiding the web in a direction of forward travel into said preliminary washing device, from said preliminary washing device to said dyeing liquor application mechanism and in a reverse direction from said dyeing liquor application mechanism, into and through said steamer, from said steamer into said final washing device and out of said final washing device, the path of said web in the forward direction being essentially below the path of said web in the reverse direction.

2. Apparatus according to claim 1, wherein said final washing device is arranged ahead of said preliminary washing device as viewed in the direction of forward travel and wherein said means for guiding include means for guiding said web below said final washing device and then into said preliminary washing device.

3. Apparatus according to claim 2, and further including adjacent feeding and removal devices disposed on the side of said dual washing device opposite said steamer and wherein said means for guiding further comprise means for conducting the web from the feeding device to said preliminary washing device and from said final washing device to said removal device.

4. A method of improving the compactness and accessibility of an installation for dyeing textile material in web form which includes a preliminary washing device, a dyeing liquor application mechanism, a steamer and final washing device comprising:

(a) disposing the preliminary washing device and final washing device immediately adjacent to each other in a common housing whereby both of said washing devices can be fed by a common set of pumps and piping;

(b) feeding said web to and through said preliminary washing device and then to said dye liquor application mechanism in a forward travel direction;

(c) reversing the direction of travel of said web in the vicinity of said dye liquor application mechanism; and (d) feeding said web in a reverse direction through said steamer and to and through said final washing device.

5. A method according to claim 4, wherein said final washing device is arranged ahead of said preliminary washing device as viewed in the direction of forward travel and further including the step of guiding said web below said final washing device and then into said preliminary washing device.

6. A method according to claim 5, wherein said installation further includes adjacent feeding and removal devices disposed on the side of said dual washing device opposite said steamer and further including the steps of guiding said web from said feeding device to said preliminary washing device in a forward direction and from said final washing device to said removal device in a reverse direction, such that the web travelling in said forward direction is below the web travelling in said reverse direction whereby only a single access path to said feeding and removal devices is necessary thereby permitting a single operator to watch both said feeding device and removal device.

* * * * *